US005884760A

United States Patent [19]

Carpenter

[11] Patent Number: 5,884,760

[45] Date of Patent: Mar. 23, 1999

[54] EMERGENCY EVACUATION KIT

[76] Inventor: Sharon L. Carpenter, 254 Deerpath Rd., New Kensington, Pa. 15068

[21] Appl. No.: 800,857

[22] Filed: Feb. 14, 1997

Related U.S. Application Data

[60] Provisional application No. 60/011,782 Feb. 16, 1996 and provisional application No. 60/018,648 May 30, 1996.

[51] Int. Cl.[6] ..... B65D 85/18

[52] U.S. Cl. ..... 206/223; 2/88; 40/599; 40/617; 206/278; 206/459.5; 206/803

[58] Field of Search ..... 2/7, 8, 46, 69, 2/81, 84, 85, 88, 89, 93, 97, 1; 40/459, 508, 584, 599, 617; 206/278, 279, 292, 459.5, 803, 223

[56] References Cited

U.S. PATENT DOCUMENTS

| | | | |
|---|---|---|---|
| 752,463 | 2/1904 | Morris . | |
| 1,625,547 | 4/1927 | Kessler . | |
| 1,857,824 | 5/1932 | Scholz et al. . | |
| 2,829,791 | 4/1958 | Berst | 206/459.5 |
| 2,982,392 | 5/1961 | Bossone . | |
| 3,467,085 | 9/1969 | Cormier | 206/803 |
| 3,522,612 | 8/1970 | Palmer | 2/88 |
| 3,935,944 | 2/1976 | Wilson et al. | 206/223 |
| 4,078,264 | 3/1978 | DeGennaro et al. | 2/88 |
| 4,216,598 | 8/1980 | Newbert | 40/617 |
| 4,390,096 | 6/1983 | Goldenberg | 206/278 |
| 4,422,852 | 12/1983 | Mathias | 40/617 |
| 4,437,568 | 3/1984 | Hamblin | 206/223 |
| 4,726,365 | 2/1988 | Jablonski | 128/202.13 |
| 4,752,971 | 6/1988 | Meserol | 2/88 |
| 4,975,984 | 12/1990 | Sting | 2/88 |
| 4,998,424 | 3/1991 | Lambert, II | 70/63 |
| 5,088,116 | 2/1992 | Gould | 2/88 |
| 5,425,155 | 6/1995 | Marciniak | 16/112 |
| 5,481,767 | 1/1996 | Lewis | 190/2 |
| 5,540,714 | 7/1996 | Payne, Jr. et al. | 606/201 |
| 5,560,491 | 10/1996 | Romaniuk et al. | 206/803 |
| 5,579,288 | 11/1996 | Malloy et al. | 206/459.5 |
| 5,628,066 | 5/1997 | Gottlieb et al. | 2/88 |
| 5,657,489 | 8/1997 | Ponstein | 2/88 |

*Primary Examiner*—Jim Foster

*Attorney, Agent, or Firm*—Webb Ziesenheim Bruening Logsdon Orkin & Hanson, P.C.

[57] ABSTRACT

An emergency fire evacuation kit comprising a package having one substantially transparent side, a carrying means, a blanket or poncho of a fire-resistant material, the material producing no noxious fumes or odors when burned, a flashlight and indicia.

18 Claims, 5 Drawing Sheets

EMERGENCY EVACUATION KIT

CROSS REFERENCE TO RELATED APPLICATION

This application claims the benefit of U.S. Provisional Patent Application Ser. No. 60/011,782, filed Feb. 16, 1996 and U.S. Provisional Patent Applicaton Ser. No. 60/018,648, filed May 30, 1996, both entitled Emergency Fire Evacuation Kit.

BACKGROUND OF THE INVENTION

1. Field of the Invention

This invention relates to an emergency kit, and more particularly, to a fire emergency kit to aid individuals in evacuating a building due to a threat of fire.

2. Brief Description of the Prior Art

Emergencies can arise in many situations, such as in the home, the automobile and the workplace. Over the years, emergency kits have been developed that address many of these situations. For example, U.S. Pat. No. 752,463 to Morris discloses an emergency case having a hinged box containing medical supplies and a first-aid book. U.S. Pat. No. 2,982,392 to Bossone discloses a safety kit for motor vehicles having a box-like container for an emergency supply of gasoline. This safety kit also may include other items necessary for motor cars, such as: a tire gauge, an anti-fog cloth, road reflectors, an ice scraper, safety tape, yellow light filters, a trough light and a tire cutter. U.S. Pat. Nos. 1,857,824 to Scholz et al. entitled "Emergency Kit for Automobiles" and 1,625,547 to Kessler entitled "Emergency Kit" are similar in nature to the Bossone and Morris patents.

U.S. Pat. No. 3,935,944 to Wilson et al. discloses a diagnostic display package having a transparent cover and small receptacles within. The package is useful for conveniently storing and displaying medical diagnostic tests. U.S. Pat. No. 4,726,365 to Jablonski discloses an air filtering apparatus for use in aircraft emergencies. The apparatus includes a pouch containing an air filtration mask. The pouch is affixed to other commonly found aircraft emergency apparatus, such as an airsickness bag or a card explaining emergency procedures. The apparatus also includes a transparent cover whereby a passenger may visualize the air filter mask within and instructions for using the filter mask, the instructions being visible when the pouch is in an unopened state.

Fire emergencies pose particular challenges to persons dwelling in large multi-unit facilities, such as personal care homes, dormitories and hotels. Aged or infirm residents or residents unfamiliar with their surroundings can become confused during emergencies or fire drills. This stems in part from the amount of material each resident must remember during the emergency. Furthermore, many facilities do not provide the basic necessities needed for escape from fire emergencies, including fire-resistant blankets, flashlights and instructions on how to escape from a given room in the structure.

Generally, multi-unit facilities provide instructions to aid individuals in identifying a proper escape route. Some multi-unit facilities provide flashlights and blankets to protect the residents as they attempt to escape from their apartments or dwelling rooms. Some facilities also provide fire-safety devices that attach to the doors of the apartments. These devices indicate that the apartments have been evacuated. However, in emergency situations many residents of multi-unit facilities panic and cannot and do not locate these various items, which can result in an unnecessary loss of life.

Therefore, it is an object of my invention to improve the safety of persons living in multi-unit facilities. There is a need for an accessible, compact, portable kit providing necessities for escape from a fire or other emergencies, particularly in multi-unit facilities.

SUMMARY OF THE INVENTION

My invention improves the safety of persons who in emergency situations may need protection from fire and/or particularly those living in multi-unit facilities and is a kit containing articles important in assisting a person in a confined space to evacuate during threat of a fire or other emergencies. The kit contains a fire-resistant blanket or poncho, and space to insert drawings showing locations of exit routes and other pertinent instructions or indicia, such as evacuee identification and important telephone numbers, a flashlight and a fire-safety strip or device presented in a package. The package may have one or more transparent or semi-transparent sides allowing easy identification of the package's contents and viewing of the indicia. The blanket is made of a material that resists burning and does not emit noxious odors or fumes when burned. Preferably, the blanket or poncho is made of wool. The blanket may have a slit or hole in it making it into a poncho and permitting a person's eyes to be exposed when the blanket is over their head. A poncho fits over the evacuee's head, shoulders and arms and allows the hands to be free to hold other objects. The blanket or poncho may have a fastener to hold the blanket or poncho in place about the evacuee's body. The fastener is preferably a zipper or a loop and hook fastener. The flashlight can be used to guide the evacuee in low-lighting situations that are often present during fire and other emergencies.

Evacuation can be confusing, especially in regard to the aged and infirm. By combining either a blanket or poncho, a flashlight and pertinent indicia in a transparent or semi-transparent package, the evacuee can see what is inside and will not need to worry about what is needed or where to find it. The indicia removes a source of confusion by depicting the escape route, reminding the evacuee of where to go. The kit will thereby relieve the evacuee of the confusion of what to bring, where to get it and where to go during an emergency. Furthermore, even if there is no confusion concerning what to do and where to go, the kit is a convenient means of ensuring that the evacuee and all occupants of a multiple-dwelling have the basic means to quickly and safely evacuate the dwelling.

The kit is portable, preferably having a carrying arrangement, such as handles, and at least one transparent or semi-transparent side, allowing a person to readily view the contents of the kit. The carrying arrangement permits a person to carry the kit during an emergency. The carrying arrangement can also serve as a device for hanging the kit in a convenient and easily accessible location.

The kit may further include a fire-safety strip. The fire-safety strip is made of an elongated strip of a flexible, resilient material having a hole at one end. The fire-safety strip is adapted to be placed on an interior doorknob of an entry door of the evacuee's dwelling and/or apartment by passing the doorknob through the hole. During an emergency, the fire-safety strip is grasped by the evacuee while exiting the apartment and is trapped by the door upon closing the door leaving an end of the fire-safety strip protruding outside the dwelling room. The protruding end of the fire-safety strip indicates to rescue personnel that the apartment is empty.

A complete understanding of the invention will be obtained from the following description when taken in connection with the accompanying drawing figures wherein like reference characters identify like parts throughout.

DESCRIPTION OF THE PREFERRED EMBODIMENTS

Figure 1:
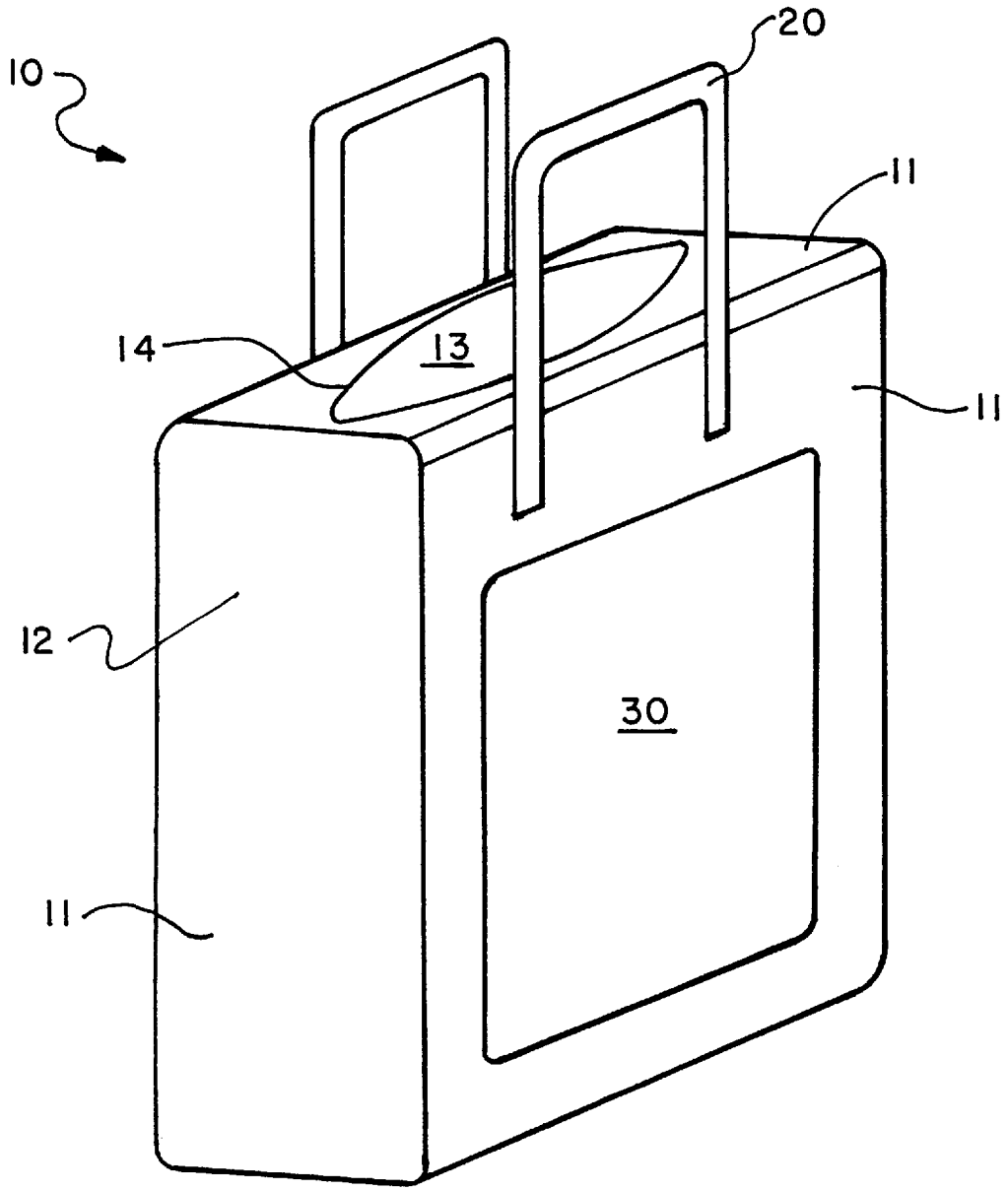
FIG. 1 shows perspective view of the emergency evacuation kit package made in accordance with the present invention.
Figure 2:
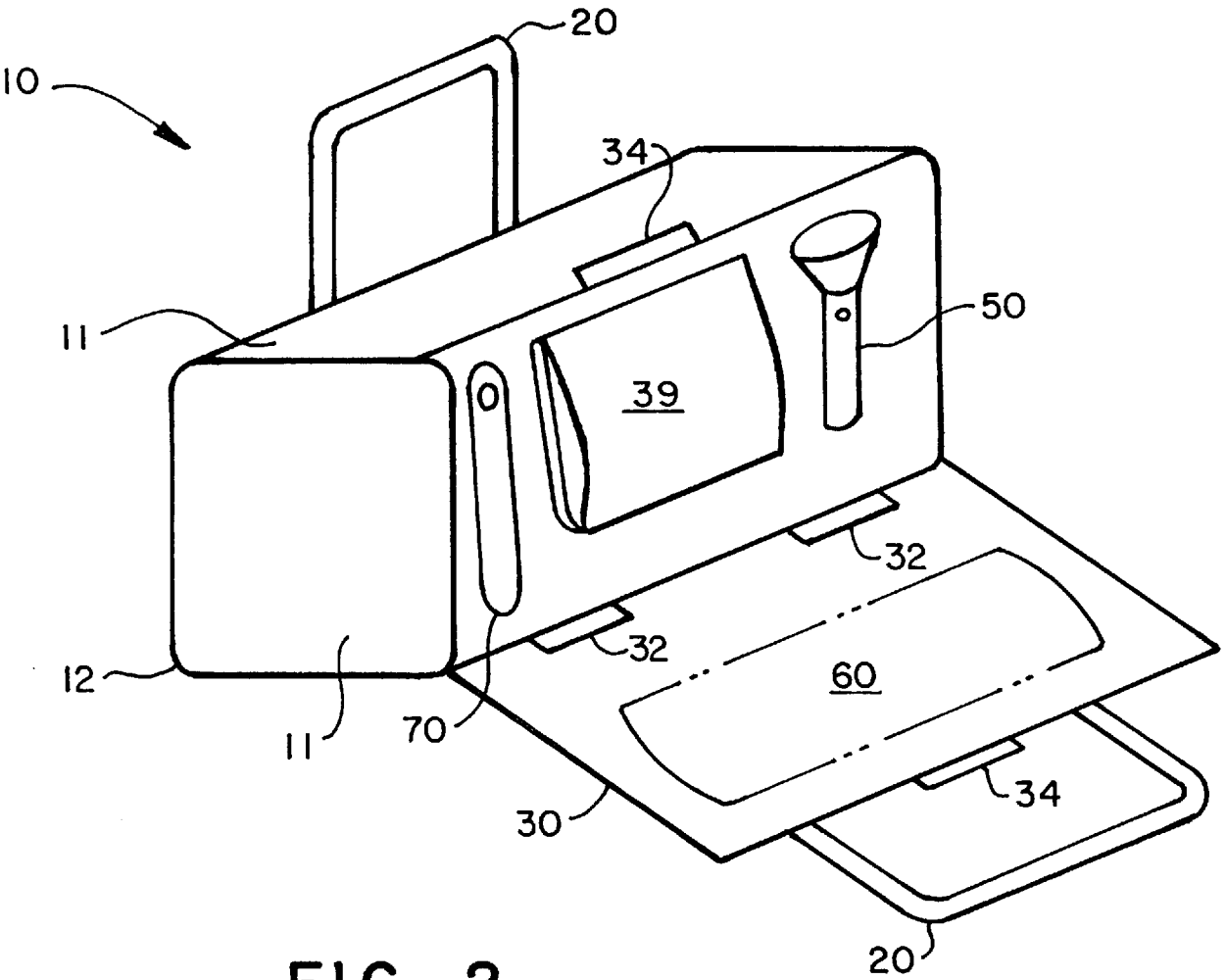
FIG. 2 shows an alternative emergency evacuation kit package.
Figure 3:
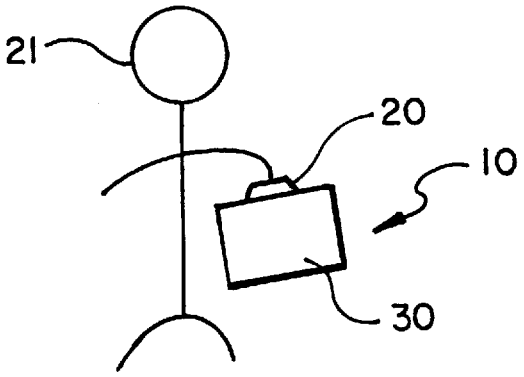
FIG. 3 shows an elevational view of an evacuee holding the emergency evacuation kit as shown in FIG. 1.

FIGS. 1 and 2 show a portable kit 10 having a package 12 including a carrying arrangement or handles 20. The package 12 is defined by a plurality of walls 11 and an opening 13 which may be closed by a fastener 14, such as a zipper or a hook and loop fastener, better known as Velcro®. Included as part of the package 12 is a transparent or semi-transparent sidewall 30 that permits an evacuee to readily view the contents of the kit 10. Alternatively, as shown in FIG. 2, one of the walls, such as sidewall 30, may be hinged to (by hinges 32) or removable from the remainder of the walls of the case so that the contents can be easily removed from the case. A releasable locking arrangement 34 is provided so that the hinged wall can be maintained in a closed, locked position when not in use. Hence, an evacuee in an emergency can easily access the contents of the kit in order to lessen any confusion that may arise by the evacuee during the emergency. As shown in FIG. 3, the handles 20 permit the evacuee 21 to carry the kit 10 during an emergency. The handles 20 also can be used in conjunction with a hanger or a nail for hanging the kit 10 in an easily accessible location.

The kit 10 contains a folded blanket or poncho 39, a flashlight 50, indicia 60 and a fire-safety strip 70 as shown in the package 12 of FIG. 2. The blanket or poncho 39 is made of a material, preferably wool, that resists burning and does not emit noxious odors or fumes when burned. The blanket or poncho 39 serves to protect the evacuee from the elements. More specifically, in an emergency situation, the evacuee must often leave the dwelling room or apartment with little protection. Hence, the blanket or poncho 39 serves to shield the evacuee from flame, inclement weather and shock. The flashlight 50 can be used by the evacuee to assist him or her in low-lighting situations that are often present during fire and other emergencies.

Figure 4:
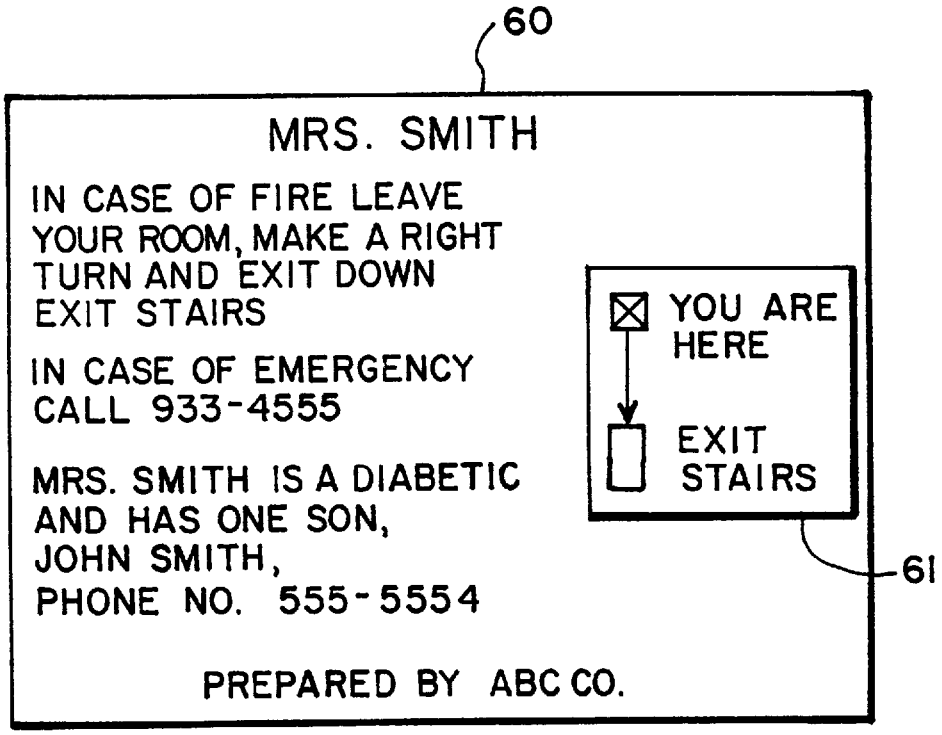
FIG. 4 is a plan view of visible indicia of the emergency kit shown in FIG. 1.

Referring to FIG. 4, the indicia 60 presents relevant information to the evacuee, such as a description of an escape route. Preferably, this description is customized for the individual evacuee. The description of the escape route includes a map or floor plan 61. The indicia 60 can include other instructions pertaining to the evacuee, such as instructions of where the evacuee should telephone in case of an emergency. The indicia 60 can further include information directed to persons assisting the evacuee, such as special medical and identification information such as a photograph of the evacuee for rapid positive identification. It is also possible that the indicia 60 include information, such as a company logo, depicting the source of the kit 10. Alternatively, the logo can be placed on the blanket or poncho 39 and/or the package 12. The indicia 60 can be provided on the inside of the package 12 or on the outside of the package 12. Further, the indicia 60 can be removable or permanently affixed to the inside or outside of the package 12. Preferably, the indicia 60 should be readable from the outside of the kit 10 if it is contained within the kit 10. The indicia 60 can be a form which is filled out upon placement of the kit 10 having the indicia 60 in the dwelling room. This allows for individualization of the indicia 60, which may include a room number or name.

Figure 5:
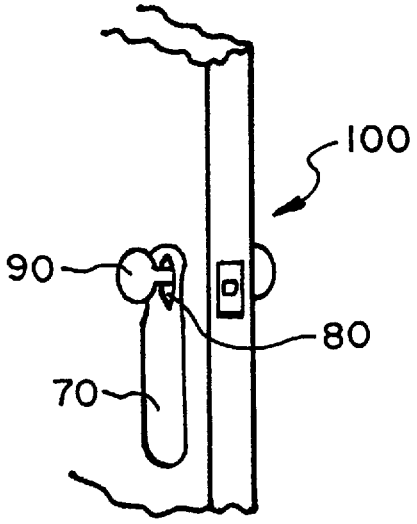
FIG. 5 shows a perspective view of a fire-safety strip made in accordance with the present invention that is attached to a in a normal position.
Figure 6:
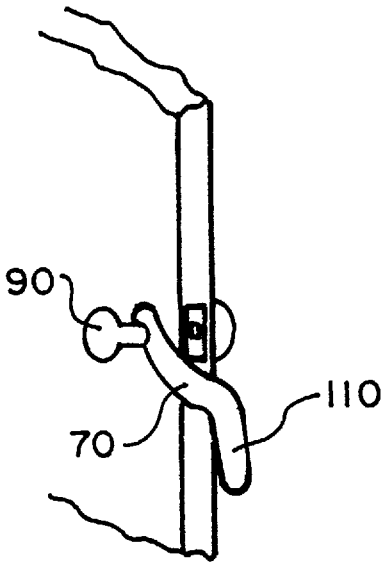
FIG. 6 shows a perspective view of the fire-safety strip shown in FIG. 4 in a trapped position after evacuation of a dwelling room.

Referring to FIGS. 5 and 6, the fire-safety strip 70 is defined by an elongated strip of a flexible, resilient material having a hole 80 at one end. The fire-safety strip 70 is placed on an interior doorknob 90 of a primary entry door 100 for the apartment by passing the doorknob 90 through the hole 80, as shown in FIG. 5. An evacuee grasps the fire-safety strip 70 while exiting the apartment during an emergency. The door traps the fire-safety strip 70 upon closing so that an end of the fire-safety strip 70 protrudes outside the apartment as shown in FIG. 6. The protruding end 110 of the fire-safety strip 70 indicates to rescue personnel that the apartment is empty.

The fire-safety strip 70 can be made of a soft, flexible, resilient material that is easily and comfortably grasped, preferably of knitted material, most preferably of wool.

Preferably, the fire-safety strip 70 includes a distinctive color, such as bright red, orange or yellow, or a distinctive pattern to allow rescue personnel to easily spot the fire-safety strip.

Figure 7:
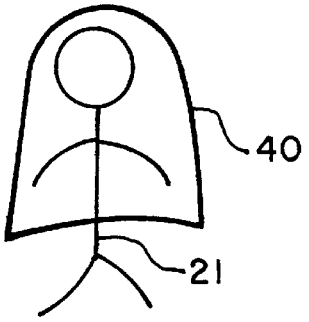
FIG. 7 shows an elevational view of an evacuee wearing the blanket.
Figure 8:
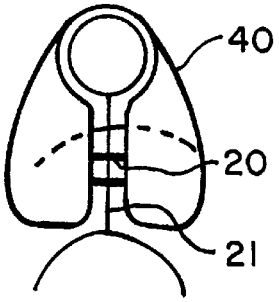
FIG. 8 shows an elevational view of an evacuee wearing the blanket having fasteners.

Referring to FIGS. 7 and 8, the blanket 40 is draped over the body, and preferably, the head of the evacuee 21. Fasteners 120 may be attached to the blanket 40 allowing the blanket to be affixed over the body of the evacuee 21 and, preferably, the head of the evacuee 21 as shown in FIG. 8. Additionally, the fasteners 120 allow the hands of the evacuee 21 to be free. The fasteners 120 can be a zipper or, preferably a hook and loop fastener.

Figure 9:
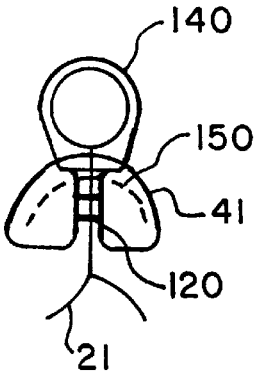
FIG. 9 shows an elevational view of an evacuee wearing the poncho having fasteners and a hood, the poncho is formed to fit about the shoulders of the evacuee.
Figure 10:
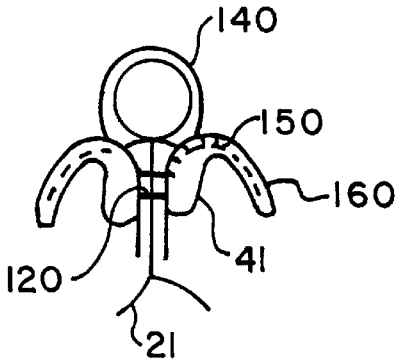
FIG. 10 shows an elevational view of the poncho having a hood, arms, fastener, the poncho is formed to fit about the shoulders of the evacuee.

Referring to FIGS. 9 and 10, the poncho 41 has a hood portion 140, fasteners 120 and shoulders 150. The poncho 41 is made of the same material as the blanket 40 and can be substituted for the blanket 40 in the kit 10. The poncho 41 is shaped to fit the body of the evacuee 21. The poncho 41 is preferable to the blanket 40 because it covers the body of the evacuee 21 more completely and will have a lesser tendency to fall off the evacuee's body. The hood portion 140 provides more substantial coverage to the head of the evacuee 21 and prevents falling of the poncho 41 from the body of the evacuee 21. The shoulders 150 provide a superior fit for the poncho 41, also resulting in better coverage of the evacuee's body and preventing falling of the poncho 41 from the evacuee's body. Preferably, the poncho 41 has fasteners as shown in FIG. 9 to allow the hands of the evacuee 21 to be free. Most preferably, the poncho 41 has arms 160, as shown in FIG. 10, which allow superior freedom of motion and prevents falling of the poncho 41 from the evacuee's body.

Figure 11:
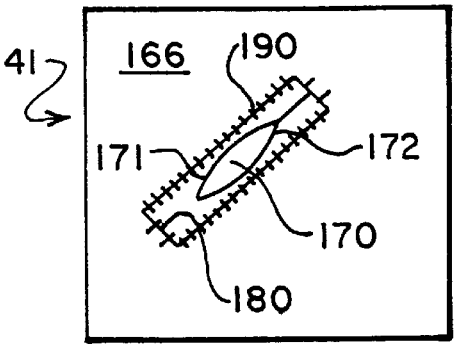
FIG. 11 shows a top view of a blanket that can be formed into a poncho.
Figure 12:
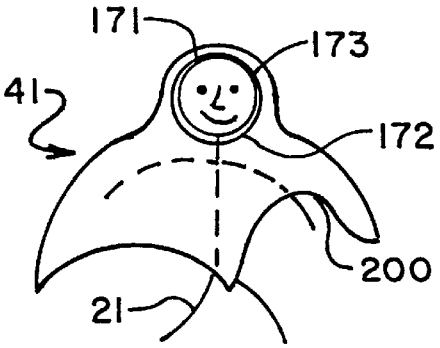
FIG. 12 shows an elevational view of an evacuee wearing the blanket of FIG. 11 formed into a poncho.

Referring to FIGS. 11 and 12, a poncho 41 can alternatively be formed by providing an opening 170 in a blanket 166, as shown in FIG. 11. The opening 170 functions as a means to provide a hood 173 which covers the head of the evacuee 21, while permitting the eyes of the evacuee 21 to be uncovered as shown in FIG. 12. The top of the hood 173 is defined by section 171 of the opening 170 while the bottom of the hood 173 is defined by section 172 of the opening 170. Optionally, the opening 170 can be opened or closed with a hook and loop fastener 180, such as Velcro® or a zipper, and the opening 170 is preferably strengthened by stitching 190. Opening 170 eliminates the need for fasteners 120 as shown in FIGS. 8–10 as the full blanket 166 drapes over the shoulders. If desired, the evacuee 21 may use his hands by lifting up the front of the blanket 166 while still obtaining the benefits of overall coverage as shown by the lifted section 200 in FIG. 12.

While the invention is described in detail herein, it will be appreciated by those skilled in the art that various modifications and alternatives to the arrangements can be developed in light of the overall teachings of the disclosure. Accordingly, the particular arrangements are illustrative only and are not limiting as to the scope of the invention which is to be given the full breadth of the appended claims and any and all equivalents thereof.

I claim:

1. An emergency evacuation kit comprising:

a) a reusable package having a portion of one side transparent;

b) a carrying means attached to the package;

c) a non-flammable blanket material stored within the package, and non-flammable material producing no noxious fumes or odors when burned;

d) indicia visible from the outside position relative to the package; and e) a fire-safety strip of a flexible, resilient material adapted to affix to a door or wall, said fire-safety strip stored within the package, wherein the fire-safety strip material is non-flammable.

2. The emergency evacuation kit of claim 1 wherein the blanket is comprised of wool.

3. The emergency evacuation kit of claim 1 wherein the fire-safety strip has an elongated shape and a hole at one end, the hole being of sufficient diameter such that the fire-safety strip can be placed over a doorknob on a door, the doorknob passing through the hole in the fire-safety strip, the doorknob being on an interior side of a dwelling area, the fire-safety strip being of sufficient length such that the fire-safety strip can be grasped by a person exiting from the dwelling area during an emergency, trapping the fire-safety strip between the door and an adjacent door jamb upon closure of the door leaving a protruding end of the fire-safety strip visible from an exterior side of the dwelling area, acting as a signal allowing rescue personnel to determine that persons within the dwelling area have exited the dwelling area.

4. The emergency evacuation kit of claim 1 wherein the fire-safety strip is marked in a manner providing superior visibility in emergency situations.

5. The emergency evacuation kit of claim 1 wherein the color of the fire-safety strip is one of red, orange and a mixture thereof.

6. The emergency evacuation kit of claim 1 wherein the indicia is located on an outer surface of the package.

7. The emergency evacuation kit of claim 1 wherein the indicia is visible through the transparent portion of the package.

8. The emergency evacuation kit of claim 1 wherein the blanket has fasteners to hold the blanket about a person's body.

9. The emergency evacuation kit of claim 1 wherein the blanket has an opening, the opening being of sufficient size such that a person may drape the blanket over their head while permitting the eyes of the person to remain uncovered.

10. An emergency evacuation kit comprising:

a) a reusable package having a portion of one side transparent and having a means for quick entry;

b) a carrying means attached to the package;

c) a poncho of non-flammable material stored within the package, the non-flammable material producing no noxious fumes or odors when burned;

d) indicia visible from an outside position relative to the package; and e) a flashlight stored within the package.

11. The emergency evacuation kit of claim 10 further comprising a fire-safety strip of a flexible, resilient material, stored within the package, adapted to affix to a door or wall.

12. The emergency evacuation kit of claim 11 wherein the flexible, resilient material is non-flammable.

13. The emergency evacuation kit of claim 10 wherein the poncho has a hood portion.

14. The emergency evacuation kit of claim 10 wherein the poncho is shaped to fit a person's form.

15. The emergency evacuation kit of claim 10 wherein the poncho has fasteners to hold the poncho about a person's body.

16. The emergency evacuation kit of claim 10 wherein the poncho has arms.

17. An occupancy evacuation device comprising of a fire-safety strip of a flexible, resilient material adapted to affix to a door or a wall wherein said fire-safety strip is non-flammable and wherein the fire-safety strip has an elongated shape, and a hole at one end, the hole being of sufficient diameter such that the fire-safety stip can be placed over a door knob on a door, the door knob passing through the hole in the fire-safety strip, the door knob being on an interior side of the dwelling area, the fire-safety strip being of sufficient length such that it can be grasped by a person exiting from the dwelling area during an emergency, trapping the fire-safety strip between the door and an adjacent door jamb upon closure of the door, leaving the protruding end of the fire-safety strip visible from an exterior side of the dwelling area, acting as a signal allowing rescue personnel to determine that persons within the dwelling area have left the dwelling area.

18. The occupancy evacuation device of claim 17 wherein said fire-safety strip is made of a distinctively bright color wool.

* * * * *